US005464151A

United States Patent [19]

Parker et al.

[11] Patent Number: 5,464,151

[45] Date of Patent: Nov. 7, 1995

[54] TEAR TAPE SYSTEM AND CONTAINER INCLUDING THE SAME

[75] Inventors: Alan Parker, Maidstone; Michael C. Chapman, East Malling; Stephen P. Pinchen, Etwall; Carl J. Stonely, Giltbrook, all of United Kingdom

[73] Assignee: P. P. Payne Limited, United Kingdom

[21] Appl. No.: 245,072

[22] Filed: May 17, 1994

Related U.S. Application Data

[63] Continuation of Ser. No. 63,572, May 19, 1993, abandoned.

[30] Foreign Application Priority Data

May 19, 1992 [GB] United Kingdom ..... 9210671

[51] Int. Cl.[6] ..... B65D 5/54; B65D 17/00

[52] U.S. Cl. ..... 229/206; 229/235; 229/237; 229/238

[58] Field of Search ..... 229/205, 206, 229/235, 238, 239, 240, 242

[56] References Cited

U.S. PATENT DOCUMENTS

| | | | |
|---|---|---|---|
| 3,136,474 | 6/1964 | Schaus et al. | 229/235 |
| 3,276,665 | 10/1966 | Rasmussen | 229/235 |
| 3,850,363 | 11/1974 | Jacobs | 229/235 |
| 3,910,482 | 10/1975 | Bamburg et al. | 229/235 |
| 3,951,333 | 4/1976 | Forbes, Jr. et al. | 229/206 |
| 4,621,736 | 11/1986 | Roccaforte | 229/239 |
| 4,784,271 | 11/1988 | Wosaba, II et al. | 229/235 |
| 5,098,757 | 3/1992 | Steel | 229/206 |
| 5,135,790 | 8/1992 | Kaplan et al. | 229/239 |

FOREIGN PATENT DOCUMENTS

| | | | |
|---|---|---|---|
| 1124021 | 8/1968 | United Kingdom | 229/235 |

OTHER PUBLICATIONS

The Wiley Encyclopedia of Packaging Technology, John Wiley & Sons, p. 15, 1986.

*Primary Examiner*—Gary E. Elkins
*Attorney, Agent, or Firm*—Larson and Taylor

[57] ABSTRACT

A container made of double faced corrugated board incorporates a tear tape (10,27) for opening it which is secured to the inside surface of walls (1,2,3,4,22) of the container. The tear tape is arranged to be pulled through one or more lines of weakness (14,23) formed in the outside of the board in alignment with the tear tape, the one or more lines of weakness not extending through the board.

15 Claims, 6 Drawing Sheets

TEAR TAPE SYSTEM AND CONTAINER INCLUDING THE SAME

This application is a continuation of application Ser. No. 08/063,572 filed May 19, 1993, now abandoned.

This invention relates to containers and is concerned with a novel board suitable for the production of a container blank for container manufacture.

It is well known to form containers for the storage and transport of goods from corrugated board, fibre board, box board and the like. Ordinarily, the board is die cut to form a container blank of a desired shape including portions defining the side, end, top and bottom portions as appropriate of the eventual container and also including appropriate fold lines so that the container can be assembled by suitably folding the blank. The blank also generally includes flaps to be adhered or otherwise secured to the side, end, top and/or bottom portions to maintain the container in its assembled state.

It is also known to provide such containers with a tear tape to facilitate opening. The tape is applied to that surface of the board which constitutes the inner surface of the container and a starter tab is usually provided whereby the tear tape can be gripped and pulled so as to rupture the board in the vicinity of the tape and thereby enable entry to the container.

It is frequently desired to use part of the opened container as a point of display unit to exhibit, for sale purposes, the goods contained in the container. However, the use of the tear tape to obtain access to the container ordinarily results in a rather ragged and untidy rupture of the board and this is too unsightly to enable the opened container to be used for display purposes.

Proposals have been made to overcome this problem and one of these involves providing a continuous slit or a plurality of perforations extending through both the board and the tape. Although this results in a much straighter and cleaner rupture of the board when the container is opened by pulling the tape, it significantly reduces the container compression strength and limits its scope of use.

It is an object of the present invention to overcome this disadvantage in an economic manner.

According to the present invention there is provided a board for container manufacture, wherein the board comprises a corrugated sheet sandwiched between, and adhered to, first and second facing sheets, and wherein the first sheet includes a tear tape and the second sheet includes a line of weakness substantially in register with the tear tape and not extending through the board to the first sheet.

The line of weakness is sufficient to cause the board to tear cleanly when the tape is pulled but, because the line of weakness does not extend completely through the board, the compressive strength of the container is not significantly reduced.

The board of the invention is readily suitable for forming into a container blank from which the container is to be assembled.

The board is double-faced corrugated board comprising a corrugated sheet sandwiched between, and adhered to, first and second facing sheets and the line of weakness preferably extends only through the facing sheet forming the second face of the board which, in turn, forms the outer surface of the final container. The line of weakness thus does not extend through the corrugated member or through the facing sheet forming the first face of the board or indeed through the tape. In this case the line of weakness may be in the form of a score line on the facing sheet forming the second face or be in the form of a slit extending through the facing sheet or be in the form of a plurality of perforations extending through the facing sheet.

The tear tape is secured to that face of the board which will constitute the inside surface of a wall of the container and is arranged to be pulled through the wall to open the container, and preferably the line of weakness is formed in the outside of the board in alignment with an edge of the tear tape and not substantially outside of that edge, such line of weakness being formed in the outside facing sheet of the board but not extending substantially into the corrugated sheet.

With such an arrangement, when the container is opened by pulling the tear tape through the container wall from the outside, the edge of the tape cuts through the line of weakness to form a cleanly cut edge on an open display tray which may thus be formed by one part of the opened container. At the same time, the fact that the line of weakness does not extend into the corrugated sheet means that the major part of the strength of the container which that sheet provides is not substantially compromised by the line of weakness up to the time when the container is opened.

In one form of the invention, a line of weakness is provided in alignment with only one edge of the tear tape and only one part of the opened container will necessarily have a cleanly cut edge. In another form of the invention two lines of weakness are formed in the outside of the board, in alignment with the respective edges of the tear tape, whereby both parts of the opened container may form a display tray with a cleanly cut top edge.

In order to facilitate opening and to assist in the formation of a cleanly cut edge, a further line of weakness may be formed on the inside of the board in alignment with the one or more lines of weakness on the outside thereof. Such a further line or lines of weakness will be formed in the inside sheet of the board but again will not extend substantially into the corrugated sheet, so that the strength of the container which is provided by that sheet is still not substantially reduced.

It should be understood that it is not essential for the or each line of weakness to be exactly aligned with the associated edge of the tear tape, so long as the line of weakness is not substantially outside of the respective edge. Indeed, in one form of the invention the or each line of weakness is located slightly inside of the associated edge of the tape, so that as the tape is pulled through the wall its edge is slightly folded back, which may have an advantageous effect in smoothing off any burrs which might otherwise be left on the cut edge of the board.

The tear tape used in accordance with the present invention is preferably such that it is capable of being split longitudinally such that the split propagates along a straight line, parallel to the tape edges, over a considerable distance.

In one embodiment, the tape is in the form of a pressure sensitive adhesive tape comprising a substrate formed of, for example, propylene copolymer or homopolymer coated with a pressure sensitive adhesive based on, for example, a natural rubber or an acrylic polymer. In this case, the thickness of the tape may be, for example, from 50 to 125 microns and its width may be from 5–20 mm. Typically, such a tape will have an elongation at break of from 15–40%, a tensile strength at break of 25–50 $Kg/mm^2$, and a modulus (10% extension) of 150–300 $Kg/mm^2$. By suitably stretching the substrate and aligning the polymer chains, it is possible to produce a very highly tensionalised tape which has the aforementioned characteristic of forming longitudinal splits which propagate along a straight line.

In another embodiment the tape is in the form of a weftless tape comprising a plurality of longitudinally extending lengths of yarn held together in parallel relationship by means of a heat activatable adhesive. Such a tape will also split longitudinally and propagate along a straight line in the desired manner. The yarns may be formed of a polyester and the adhesive used may be a hot melt adhesive having an activation temperature of from 50°–150° C. Again, the width of the tape is preferably from 5–20 mm and its elongation at break from 15–40%. Such a tape may be formulated so as to have a tensile strength at break of from 10–100 $Kg/mm^2$ and a modulus (10% extension) of from 50–800 $Kg/mm^2$.

It is preferred for the board to be cut so as to provide a starter tab in registry with the tape and the rupture line to facilitate the propagation of the rupture of the board when the tape is pulled.

The tape may be applied to the board using conventional applying equipment and is applied to that face of the board which, in use, will form the inner surface of the assembled container. Then, after application of the tape, the face which is to form the outer surface of the container is provided with the line of weakness (e.g. by means of slitting) in register with the tape. This line of weakness can be incorporated in the board during production of the board. Thereafter, the board can be die-cut in a separate operation to form the container blank and the starter tab, if desired, can be provided in the board at an appropriate location at this time. As an alternative to providing the line of weakness during the manufacture of the board, this can be done at a later stage when the container blank is being prepared.

For a better understanding of the invention and to show how the same may be carried into effect, reference will now be made, by way of example, to the accompanying drawings in which:

FIG. 1 is a perspective view of a container formed from a board in accordance with a first embodiment of the present invention, FIG. 2 shows a part of the container of FIG. 1 on an increased scale, FIG. 3 shows, on a reduced scale, a container blank for assembly to obtain the container of FIGS. 1 and 2, FIG. 4 is a section along line X—X of FIG. 3 on an exaggerated scale, and FIG. 5 is a view corresponding to FIG. 4 illustrating a board in accordance with another embodiment of the present invention.

Figure 1:
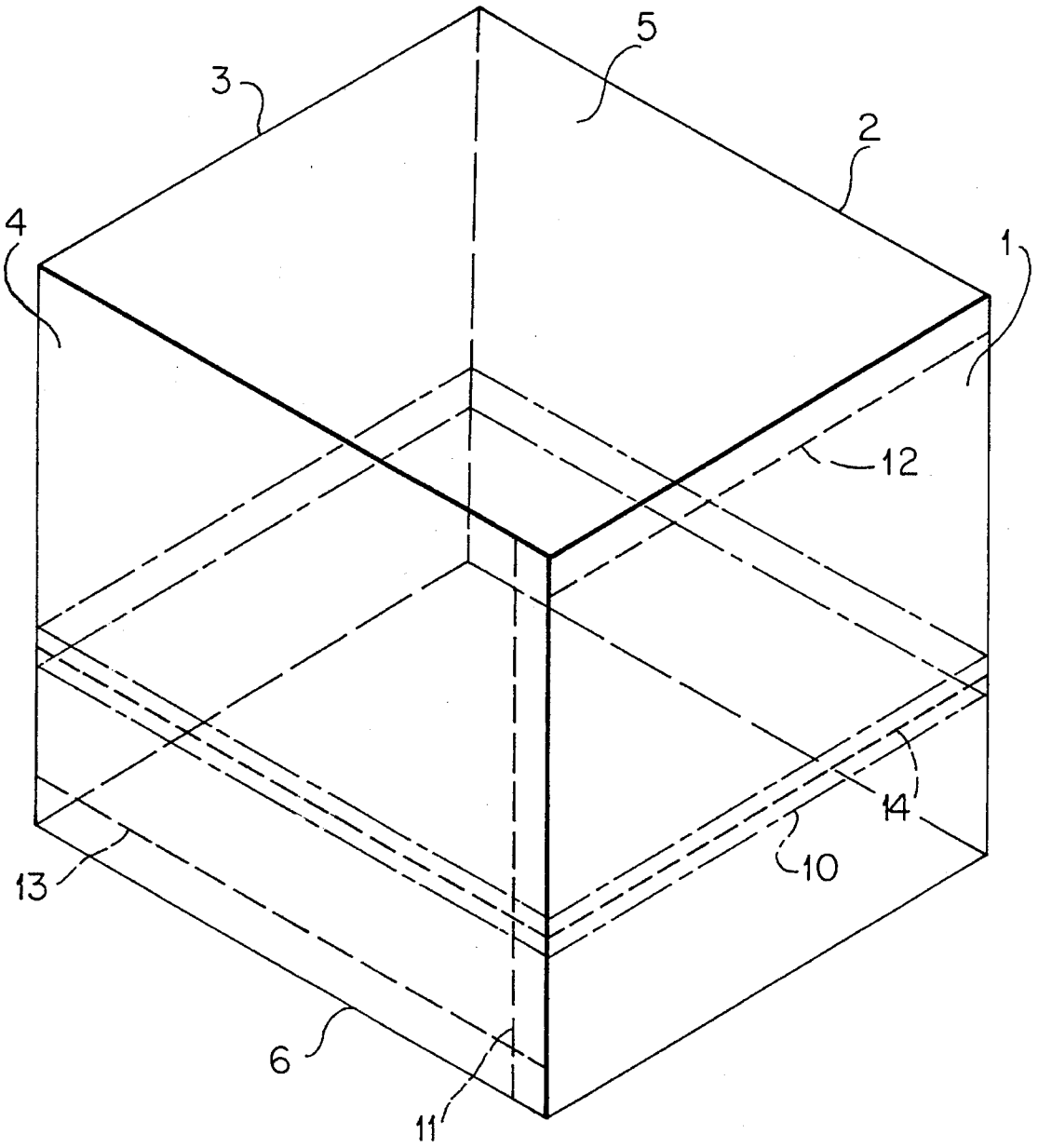
Figure 2:
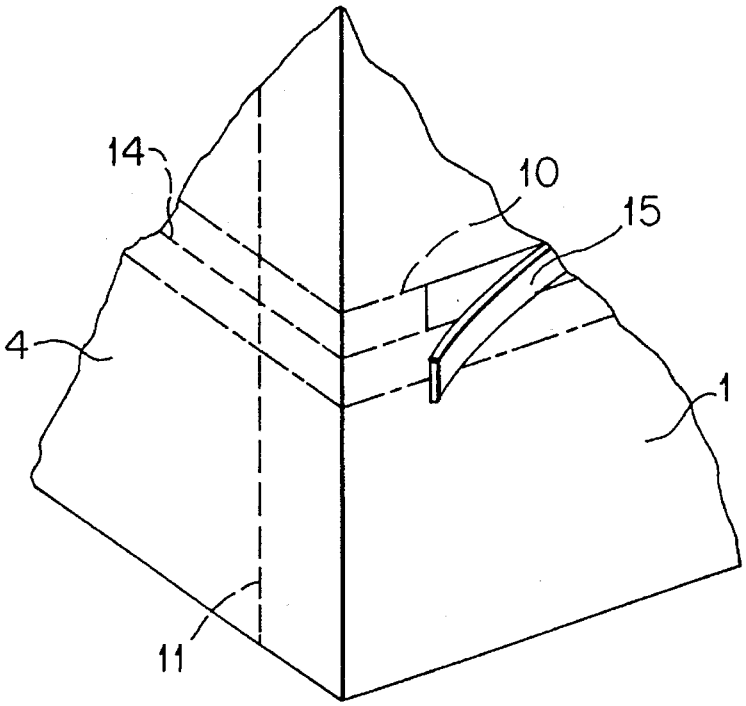

Referring now to FIGS. 1 and 2, the container is generally rectanguloid in shape and includes side portions 1 and 3, end portions 2 and 4, top portion 5, and bottom portion 6. Tear tape 10 is adhered to the inner surface of the container so that it extends around side portions 1, 2, 3 and 4. Line of weakness 14 is provided on portions 1 to 4 in registry with tape 10. This line of weakness is in the form of perforations extending only partially through portions 1 to 4. Starter tab 15 is provided in side portion 1 in registry with tape 10 and line of weakness 14.

Figure 3:
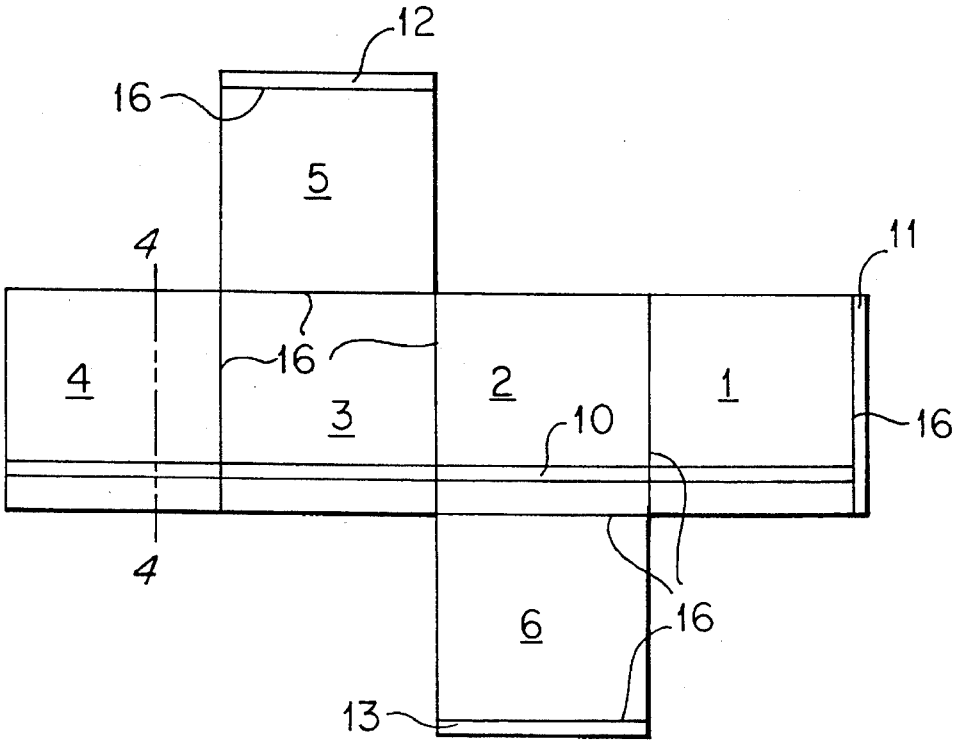
Figure 4:
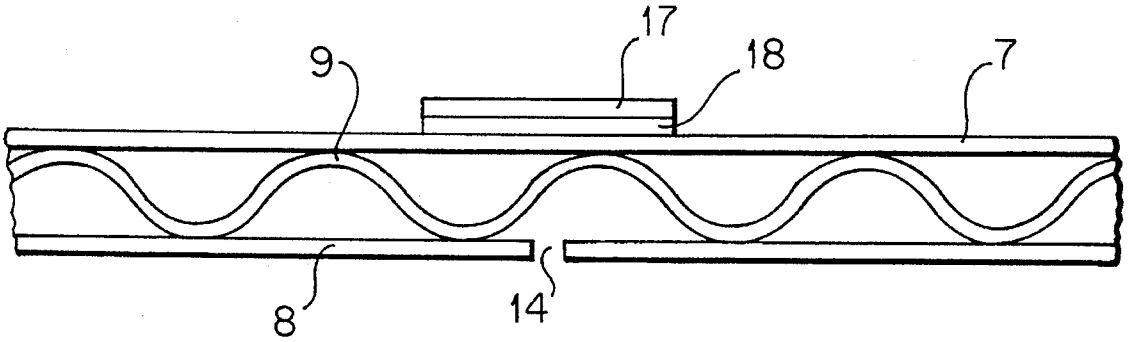

The container is formed from a container blank as shown in FIGS. 3 and 4 which has been die-cut out of a board in accordance with the present invention. As shown in FIG. 4, the board is a corrugated board including facing sheet 7 constituting a first face of the board, second facing sheet 8 constituting a second face of the board, and corrugated sheet 9 sandwiched between, and adhered to, facing sheets 7 and 8 in conventional manner. Tear tape 10 is provided on facing sheet 7 and comprises polypropylene substrate 17 coated with pressure sensitive adhesive 18 whereby the substrate is adhered to facing sheet 7. The tape is applied to the board and the line of weakness is formed in registry with tape 7 before the board is cut to form the container blank at which time starter tab 15 is also preferably provided.

The container blank includes portions 1 to 6 and also includes flaps 11, 12 and 13 on portions 1, 5 and 6, respectively. Fold lines 16 are provided between adjacent portions and flaps to facilitate assembly of the container blank to form the container and adhesive is provided on flaps 11, 12 and 13 so that they may be secured to end portion 4, top portion 5 and side portion 1, respectively to maintain the container in its assembled state. The container blank is such that, on assembly, facing sheet 7 of the board forms the inner surface of the container.

In use, starter tab 15 (to the inner surface of which is adhered tape 10) is gripped and pulled so that it cuts through portions 1 to 4 of the board along line of weakness 14 and is itself split longitudinally in registry with the line of weakness. The split in the tape propagates longitudinally and ensures that a straight cut is propagated around the board in registry with the line of weakness thus providing a clean ruptured edge. Bottom portion 6 and the reminder of portions 1 to 4 attached thereto can then be used as a tray suitable for point of sale merchandising.

Figure 5:
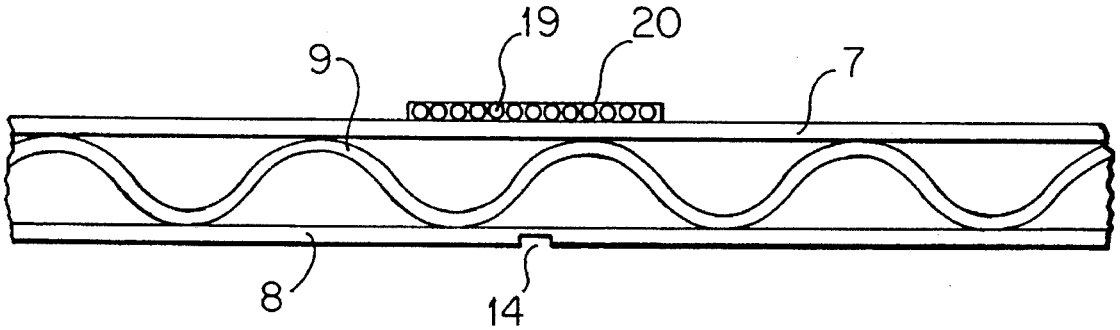

Referring now to FIG. 5, parts corresponding to parts of FIG. 4 are denoted by like reference numerals. In this case, the tear tape is in the form of a weftless tape comprising a plurality of parallel yarns 19 held together, and adhered to facing sheet 7, by means of hot melt adhesive 20. Also, in this case, the line of weakness is in the form of a score line on the surface of facing sheet 8 forming the outer surface of the container. The board is made in an analogous fashion to that of FIG. 4 and is similarly formed into a container blank for container manufacture.

Figure 6:
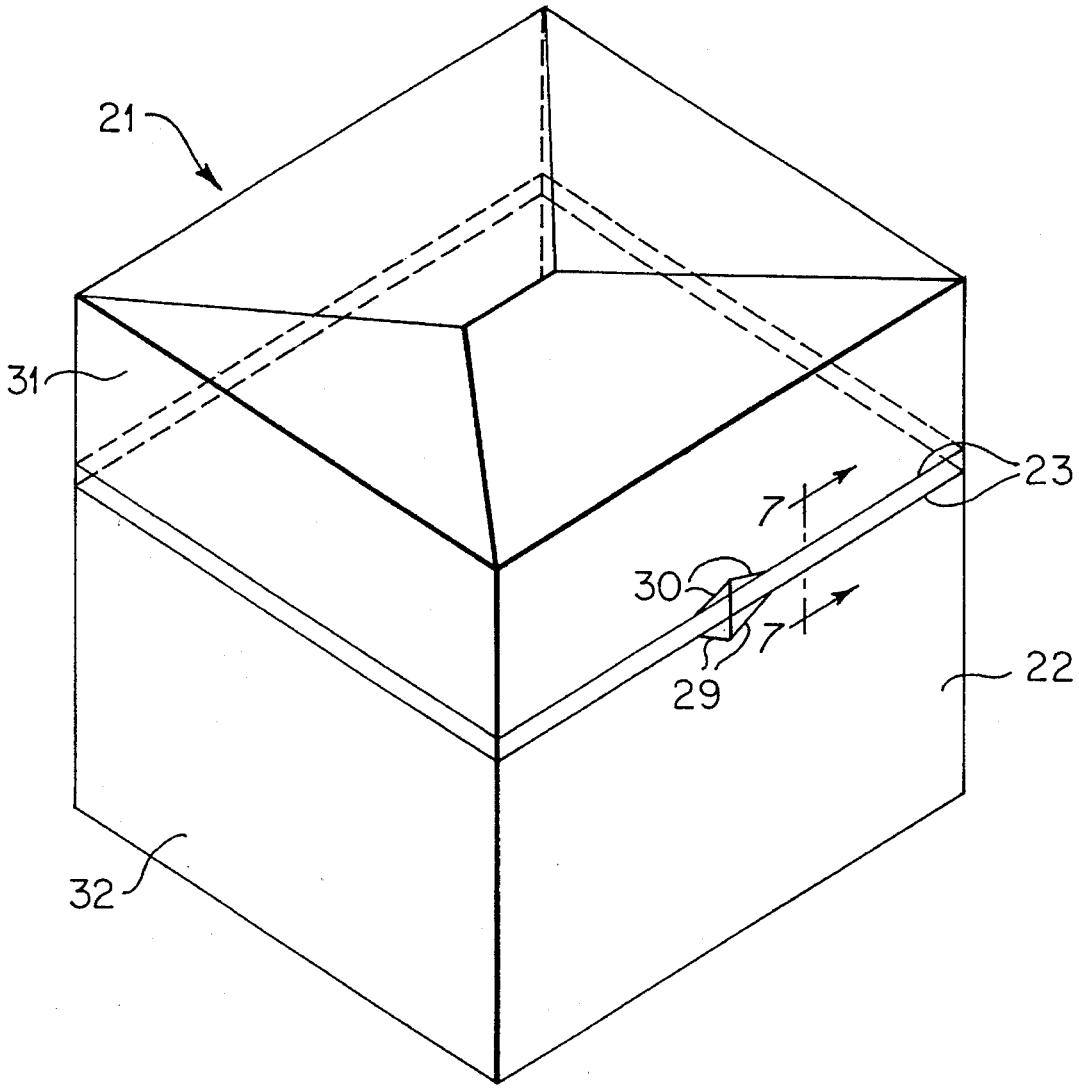
FIG. 6 is a perspective view of a container in accordance with a further embodiment of the present invention.

In FIG. 6, closed container 21 incorporates a tear tape (not shown) secured to the inside surface of the container's four side walls 22. Lines of weakness 23 are provided on the outside surface of the container's walls 22 each of which is arranged to be in alignment with an edge of the tear tape.

Figure 7:
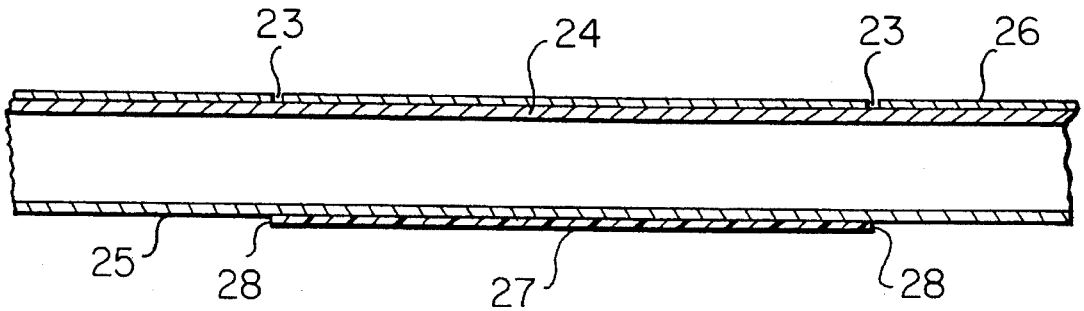
FIG. 7 is a cross-sectional view of a wall of the container along line A—A of FIG. 6, according to one form of the embodiment.

As is shown in FIG. 7, container 21 is made of double-faced corrugated board wherein corrugated sheet 24 is sandwiched between inside and outside sheets 25,26. According to the embodiment shown in FIG. 7, tear tape 27 is secured to inside sheet 25 of the board in such a way that edges 28 are in alignment with lines of weakness 23 formed in the outside surface of the board. Lines of weakness 23 are arranged to perforate outside sheet 26 of the board and not to extend substantially into corrugated sheet 24. Since the majority of the container's strength resides in corrugated sheet 24, this strength is not substantially compromised by such lines of weakness. The lines of weakness may be provided as lines of closely spaced perforations although continuous score or cut lines may equally be used.

Figure 8:
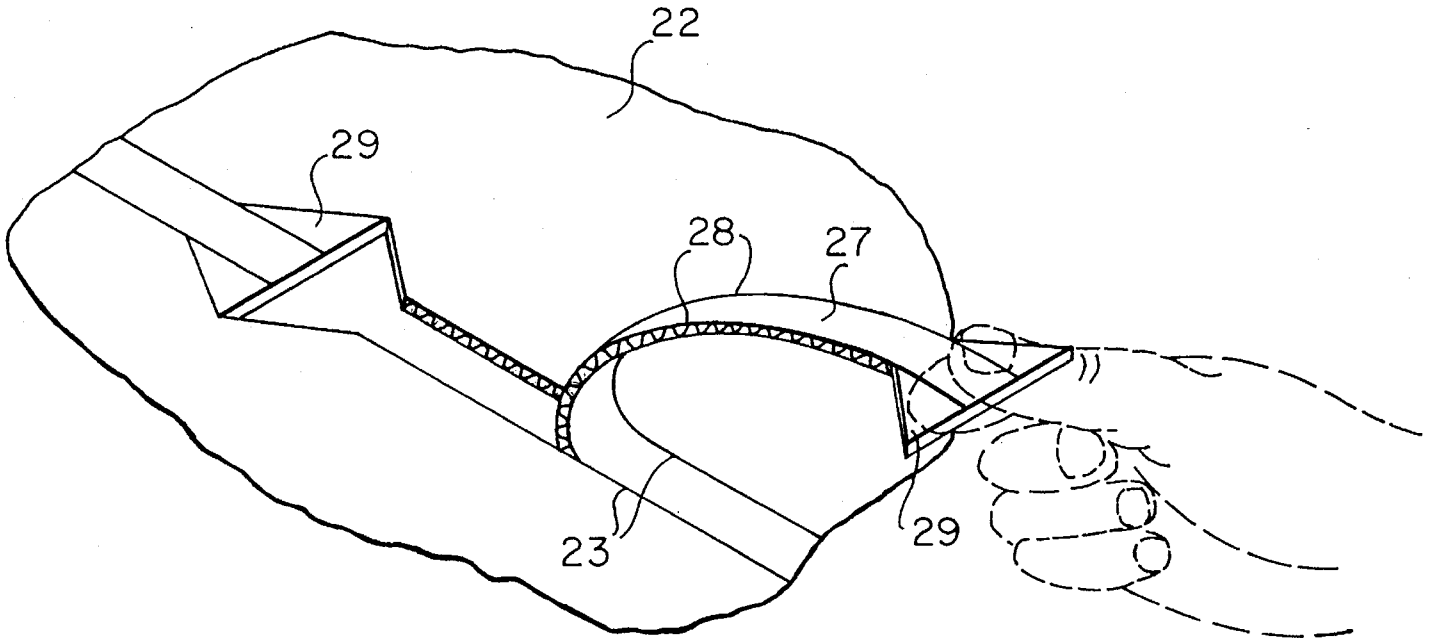
FIG. 8 is a perspective view of a side of the container according to the form of the embodiment of FIG. 7, showing the container being opened.

To open the container a user grasps tabs 29, which are formed by parts of the container wall and are attached to respective ends of tear tape 27, and pulls the tear tape through lines of weakness 23 as shown in FIG. 8. To ensure easy removal of tabs 29 from wall 2, the tabs are defined by lines of weakness 30 which may be slit-lines, score-lines or perforations.

The cutting action of edges 28 of tear tape 27 through the lines of weakness provides cleanly cut edges on both of the resulting open trays formed from top 31 and bottom 32 parts of the container, once the tear tape has been pulled through all four walls 22. Each tray so formed can therefore be used for displaying the contents of the container.

The embodiment shown in FIGS. 7 and 8 incorporates two lines of weakness 23 in alignment with respective edges 28 of tear tape 27. Should however only one clean edge on the opened container be required, only one line of weakness need be provided in alignment with one edge of the tear tape.

Figure 9:
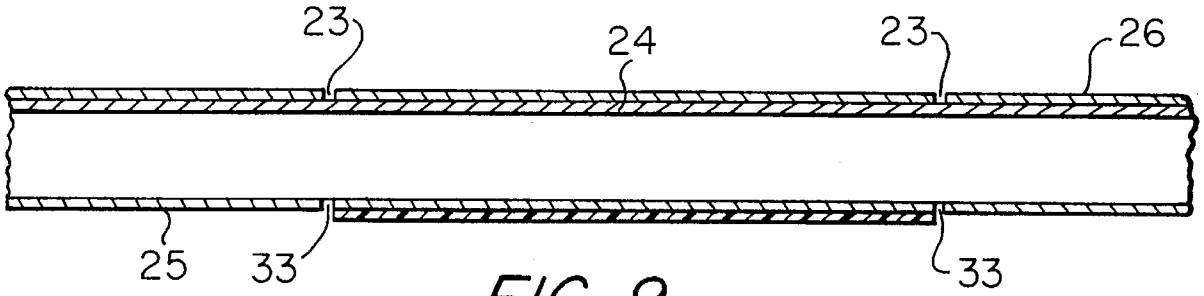
FIG. 9 is a cross-sectional view of a wall of the container along line A—A of FIG. 6, according to another form of the embodiment.

In order to facilitate opening and to assist in the formation of a cleanly cut edge, further lines of weakness 33 may be formed on the inside of the board forming container wall 22, as shown in FIG. 9. These lines of weakness are shown in alignment with lines of weakness 23 on the outside of the board and are arranged to perforate inside sheet 25 of the board but again do not extend substantially into corrugated sheet 24. The strength of the container provided by corrugated sheet 24 is therefore still not substantially affected.

Figure 10:
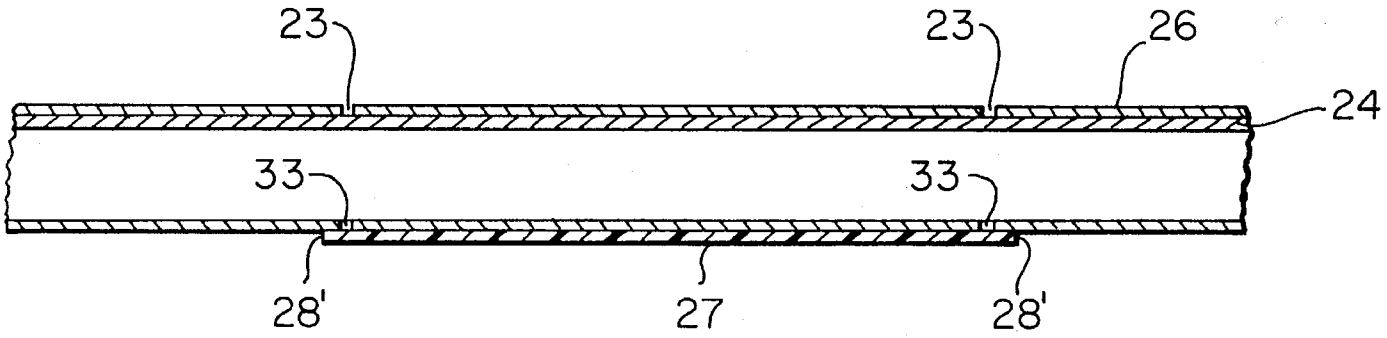
FIG. 10 is a cross-sectional view showing a modification of the form of the embodiment of FIG. 9.
Figure 11:
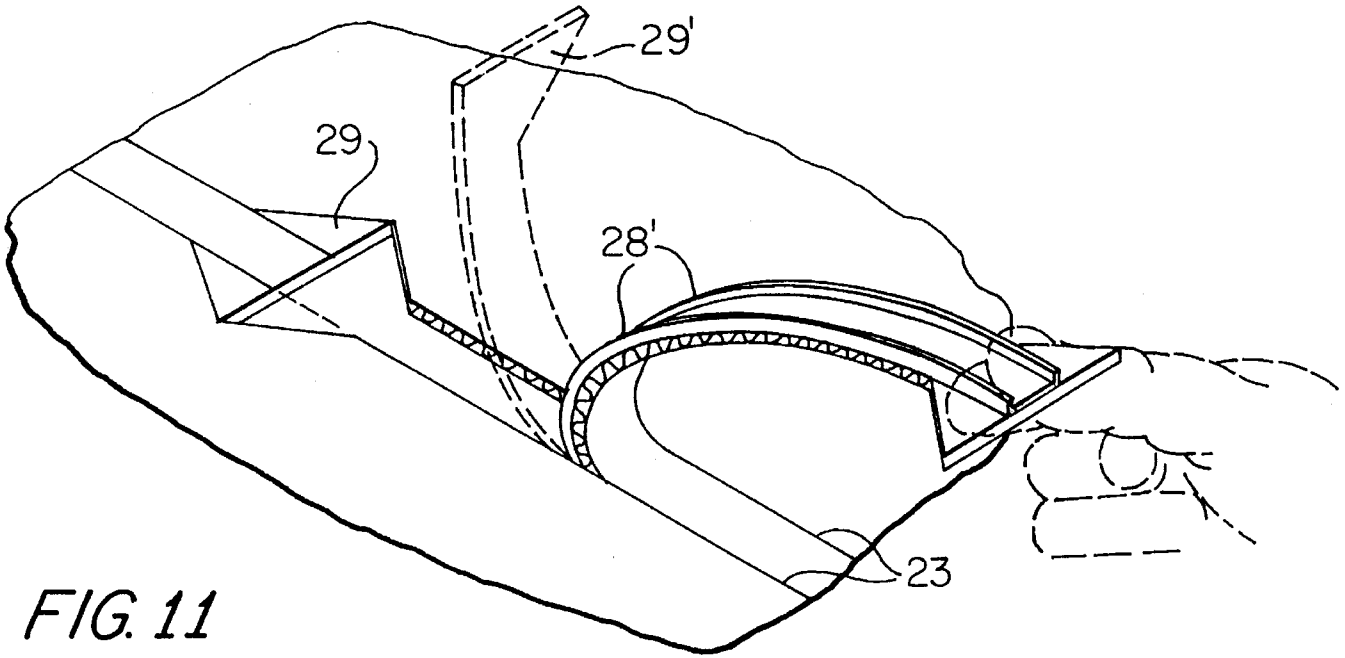
FIG. 11 is a perspective view of the container according to the form of the embodiment of FIG. 10 showing the container being opened.

In the arrangement shown in FIGS. 10 and 11, edges 28' of tear tape 27 each project marginally beyond lines of weakness 23, 33 so that the lines of weakness are aligned so as to be not substantially outside the associated edges of the tear tape e.g. so that they are located slightly inside of the associated edge of the tape. Thus when the tear tape is pulled through the board, these edges are biased against the sides of the board being cut. The effect of this is to smooth off any residual burr which might otherwise be left on the edge which has been cut.

FIG. 11 also shows, in phantom lines, an alternate form of starting tab 29' which has a single winged portion as opposed to a double winged portion.

It can therefore be seen that the present invention provides a board suitable for container manufacture which is of a strong construction but which may, nevertheless, permit controlled tearing along predetermined lines of weakness to open the container as required.

We claim:

1. A board for container manufacture, the board comprising a corrugated sheet sandwiched between, and adhered to, first and second facing sheets, wherein the first sheet includes a tear tape having a width and two edges and the second sheet includes a line of weakness substantially in register with the tear tape and a further line of weakness substantially in register with the tear tape, wherein each line of weakness does not extend through the board to the first sheet.

2. A board as claimed in claim 1 wherein the tape is a pressure sensitive adhesive tape comprising a substrate and a pressure sensitive adhesive.

3. A board as claimed in claim 2 wherein the substrate is a propylene-based polymer and the pressure sensitive adhesive is an acrylic polymer.

4. A board as claimed in claim 1 wherein the tape is a weftless tape comprising a plurality of longitudinally extending lengths of yarn and a hot melt adhesive.

5. A board as claimed in claim 1 wherein each of the lines of weakness is located slightly inside of an edge of the tape.

6. A board as claimed in claim 1 wherein each line of weakness is aligned with an edge of the tear tape.

7. A board as claimed in claim 1 wherein each line of weakness is aligned so as to be not substantially outside an edge of the tear tape.

8. A board as claimed in claim 1 wherein a further line of weakness is formed on the first sheet of the board in register with the tape.

9. A board as claimed in claim 1 wherein each line of weakness comprises a continuous cut.

10. A board as claimed in claim 1, wherein each line of weakness comprises a line of closely space perforations.

11. A board as claimed in claim 1 wherein each line of weakness does not extend into the corrugated sheet.

12. A container formed from a board, the board comprising a corrugated sheet sandwiched between, and adhered to, first and second facing sheets, wherein the first sheet includes tear tape having a width and two edges and the second sheet includes a line of weakness substantially in register with the tear tape and a further line of weakness substantially in register with the tear tape, wherein each line of weakness does not extend through the board to the first sheet.

13. A container blank for assembly into a container, said blank being formed of a board comprising a corrugated sheet sandwiched between, and adhered to, first and second facing sheets, the first sheet including a tear tape having a width and two edges and the second sheet including a line of weakness substantially in register with the tear tape and a further line of weakness substantially in register with the tear tape, wherein each line of weakness does not extend through the board to the first sheet, said blank having portions defining side, top and bottom portions of the container and fold lines so that the container can be assembled by suitably folding the blank.

14. A board for container manufacture, the board comprising a corrugated sheet sandwiched between, and adhered to, first and second facing sheets, wherein the first sheet includes a tear tape having a width and two edges and the second sheet includes a line of weakness substantially in register with the tear tape and not extending through the board to the first sheet, wherein the tape is a weftless tape comprising a plurality of longitudinally extending lengths of yarn and a hot melt adhesive, and wherein a further line of weakness is formed in the second sheet.

15. A board as claimed in claim 14, wherein the line of weakness and the further line of weakness are located slightly inside an edge of the tape.

* * * * *